US005187959A

United States Patent [19]

Davi

[11] Patent Number: 5,187,959

[45] Date of Patent: Feb. 23, 1993

[54] PROGRAMMABLE PLATE BENDING MACHINE

[75] Inventor: Orazio M. Davi, Cesena, Italy

[73] Assignee: Promau S.r.l., Cesena, Italy

[21] Appl. No.: 761,464

[22] Filed: Sep. 18, 1991

[30] Foreign Application Priority Data

Sep. 28, 1990 [IT] Italy ..... 14726/90[U]
Aug. 12, 1991 [IT] Italy ..... MI91A 002247

[51] Int. Cl.[5] ..... B21D 5/14

[52] U.S. Cl. ..... 72/9; 72/12; 72/16; 72/20; 72/21; 72/173

[58] Field of Search ..... 72/173-175, 72/166, 20, 16, 21, 12, 9

[56] References Cited

U.S. PATENT DOCUMENTS 3,955,389 5/1976 Foster .
4,047,411 9/1977 Foster ..... 72/173
4,117,702 10/1978 Foster ..... 72/173
4,486,841 12/1984 Koyama et al. .
4,761,979 8/1988 Kawaguchi et al. .
4,796,449 1/1989 Berne .

*Primary Examiner*—Daniel C. Crane
*Attorney, Agent, or Firm*—Young & Thompson

[57] ABSTRACT

A roll bending machine for bending plates or iron sheets with a programmable work cycle; a central processing unit (CPU) by suitable sensing means controls the working positions of the rolls of the bending machine adjusting them according to programmed data which can be modified each time by an operator or automatically, according to the characteristics of the plate being worked. The use of a three-point sensing device enables the diameter which the machine is conferring to the plate, to be controlled, intervening to make the necessary corrections.

16 Claims, 2 Drawing Sheets

PROGRAMMABLE PLATE BENDING MACHINE

BACKGROUND OF THE INVENTION

The present invention relates to a roll bending or plate bending machine with a programmable working cycle, of the type whereby the bending machine comprises an upper draw roll for advancing the plate, a lower gripping roll and lateral rolls for bending the plate, said rolls being supported and connected to drive means in order to be moved towards and from the upper roll. Present invention is an evolution and a development of a previous application of the same applicant.

When bending plates to form tubes or cylindrical or frustoconical bodies and the like, with a traditional bending machine, the operator has to evaluate a number of critical parameters which each time have to be correctly calculated and controlled to obtain the finished piece with the required diameter or bend. During working the critical parameters to be evaluated concern more particularly the characteristics of the iron plate to be worked, such as thickness, its modulus of elasticity, the dimensions of the metal sheet or plate and the diameter of the finished piece. The very constructional and functional characteristics of the roll bending machine may in some cases affect the bending operations.

In present roll bending machines, an operator has initially to proceed by trial and error to establish the correct value of the plate gripping pressure and the correct position of the lateral bending rolls, intervening, if necessary, to correct or adapt the working parameters of the machine so as to obtain the piece with the required diameter. Since the characteristics of the plate may vary within broad tolerances, the operator has to intervene frequently, on the basis of his personal experience, to adapt the machine to the different characteristics of the plate to be worked, without being able to ensure repeatability and constancy of results.

There is therefore the need for a plate bending machine having a programmable working cycle, with which it is not only possible to take into account the intrinsic or inherent characteristics of the iron sheet which is to be bent at that time, but which if required is able to control its own cycle and the choice of the working parameters in relation to reference data and/or preset working parameters.

Therefore, an object of the present invention is to provide a plate bending machine which is able to perform all the working phases automatically, modifying each time the working parameters of the machine according to the characteristics of the iron sheet to be bent, thus ensuring repeatability and constancy of results.

A further object of the present invention is to provide a roll bending machine for bending plate, as mentioned previously, which is not only able to control and modifing the working cycle automatically on the basis of a set program, but at the same time is capable of evaluating in advance some of the characteristics of the new iron sheet or plate to be worked, and consequently to modify the working and functional parameters.

SUMMARY OF THE INVENTION

These and further objects can be achieved by means of a programmable plate bending machine in which a central processing unit by suitable sensing means controls the working positions of the rolls of the bending machine adjusting them according to programmed data which can be modified each time by an operator or automatically, according to the characteristics of the plate being worked. The use of a three-point sensing device enables the diameter which the machine is conferring to the plate, to be controlled, intervening to make the necessary corrections.

BRIEF DESCRIPTION OF THE DRAWINGS

The invention is to be described in greater detail hereinunder, with reference to the accompanying drawings, which represent a preferred embodiment. In the drawings.

DESCRIPTION OF THE INVENTION

Figure 1:
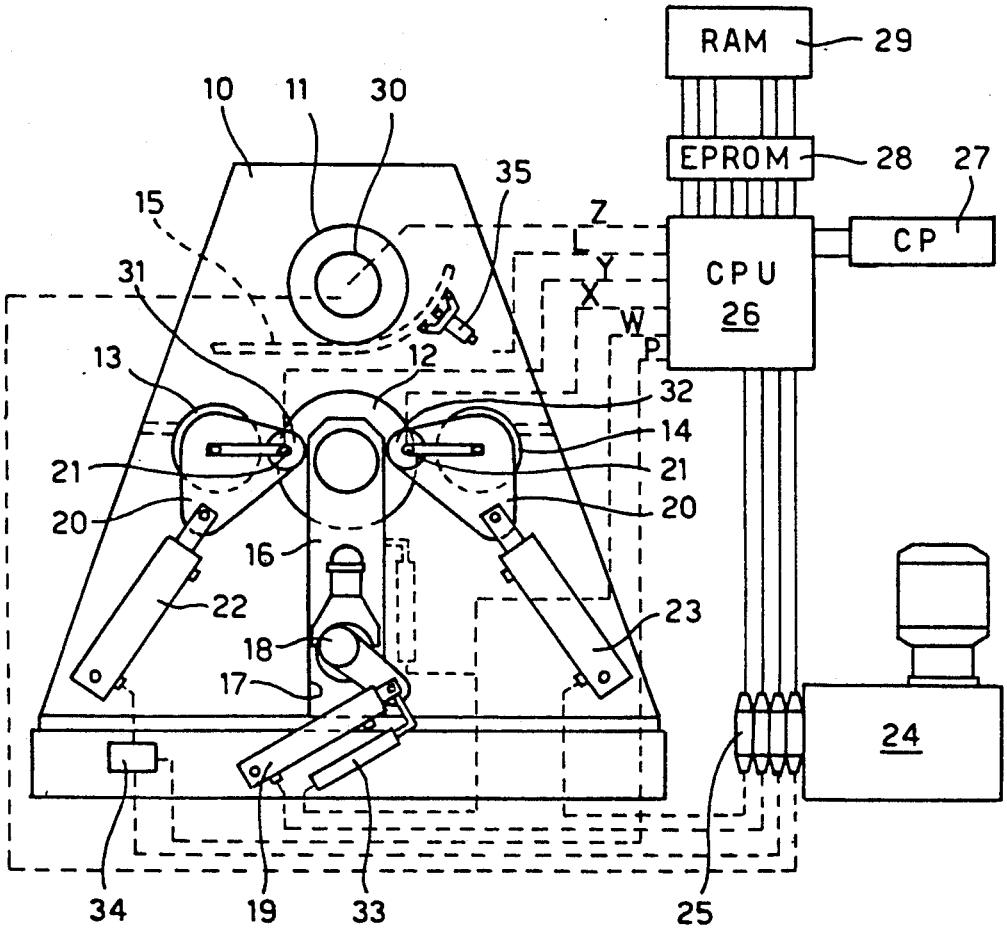
FIG. 1 is a schematic view of a bending machine according to the present invention.

As shown in FIG. 1, a roll bending machine with four rolls essentially comprises a support structure 10, an upper roll 11, suitably motorised for drawing the plate 15, a lower gripping roll 12 designed to press the plate 15 against the upper roll 11, and two lateral rolls 13 and 14 for bending the plate, suitably supported in a mobile manner to be raised and moved in a controlled manner toward the upper roll 11 to provide the plate 15 with the desired bend, as explained hereinunder.

More particularly, in the example shown, the gripping roll 12 can be moved vertically towards the upper roll 11, being supported at its ends by slides 16, (only one shown in the drawing). The slides 16 can be made to slide along guideways 17 provided on shoulders of the structure 10 of the machine, for example by a cam device 18 driven by a hydraulic cylinder 19 or in another appropriate manner.

Similarly, in the example shown, each of the lateral rolls 13 and 14 for bending the plate, is supported in order to move towards the upper draw roll 11, that is to say in order to move around an axis parallel to the rotational axis of the same roll; for this purpose each roll 13, 14 is supported at its ends by means of a pair of arms 20 pivoted to a rotation axis 21 so as to make each roll 13, 14 perform a rocking or planetary movement along an arc of a circle concentric with said axis 21. The rolls 13 and 14 are supported for idle rotation by the arms 20 said rolls having the sole function of conferring the correct diameter to the plate 15 during the bending operation.

The lateral rolls 13, 14 can be raised and lowered by any suitable drive means, for example by respective hydraulic cylinders 22 and 23 hinged to the structure 10 of the machine and, by their stem, to a respective arm 20 for supporting the rolls.

The various hydraulic cylinders of the machine, in particular for raising and lowering the gripping roll 12, the bending rolls 13, 14 and for raising and lowering the upper draw roll 11 in order to open the machine when a sleeve or finished piece has to be removed, as well as the rotation of the upper roll 11, are driven by a hydraulic power unit 24 provided with a set of solenoid valves 25, controlled by a programmable central processing unit which controls the entire working cycle of the machine.

In particular, the processing unit which controls the operations of the bending machine, comprises a processor 26 (CPU), and a coprocessor 27 (CP) capable of carrying on a dialog or supplying and receiving data or information from a set of devices for controlling the various working axes of the machine, respectively by a permanent memory EPROM 28 containing the general operating program, and by a volatile RAM 29 which can be programmed with a main working program by means of a standard programming keyboard.

As mentioned, the machine comprises a set of control devices for sensing and revealing the working parameters of the various working axes of the machine, or data and parameters characteristic of a plate being worked, which are supplied to the processor 26 and which are used to set and/or modify the working program written in the RAM 29.

In particular the apparatus comprises a first encoder 30 or electric generator of coded signals for controlling the Z rotational axis of the upper roll 11, a second and third signal generator or encoder 31, 32 for controlling the X and Y axes by means of which it is possible to identify the angular position and hence the height of the lateral rolls 13 and 14 of the bending machine; a fourth signal generator, such as a linear transducer 33 in turn supplies an indication of the position of the lower roll 12 along the W axis from which it is possible to evaluate the thickness of the plate 15; the transducer 33 may alternatively be connected directly to the slide 16, as shown by the dotted line, or in another manner. Finally a pressure transducer 34 is provided to supply the CPU with a signal proportional to the oil pressure fed the cylinder 22 (P axis) which drives the raising of the front roll 13, that is to say the roll positioned on the insertion side and which will first deform the plate. This transducer 34 is capable of measuring, at numerous points of the linear sliding of the cylinder 22, the relevant hydraulic pressures required to perform the first deformation of the plate by the front roll 13; these pressure values measured are supplied to the CPU and compared instantaneously with reference values or with other data already stored in the RAM by bending and deforming previous plates, while performing a same working program. If the pressures revealed at the same points are different from the comparison ones, for plates of the same thickness, this means that the plate which is being worked at that time has a different yield point from that of previous plates, requiring therefore a different position of the rolls 13 and 14 in order to be bent at the same diameter required; this is to be explained in greater detail hereinunder with reference to the mode of operation of the apparatus.

Likewise 35 denotes a three point sensoring means (L axis) by means of which the CPU is supplied with a signal indicating the actual bend diameter of the plate. This device can be of various types and positioned differently being moved for example along a guide 36 (P axis), by means of a drive cylinder 37 or in another suitable manner; the device, by means of a linear reading system of digital type, or analog, magnetic, light or sound emission type or laser, senses the diameter which the machine confers to the plate during bending, instant by instant.

The machine can operate by manually performing the working program or automatically.

PRELIMINARY OPERATIONS

The operator must first set up the machine for working, by resetting and bringing the two lateral rolls 13 and 14 into a totally low position, at the lower end of their stroke. The lower gripping roll 12 is raised to a high position, bringing it into mechanical pressure against the upper roll 11 reaching a preloading value determined by a relative hydraulic valve for setting the drive cylinder 19.

After having set the machine, the operator prepares it to receive a first plate to be bent by actuating the rise of the rear lateral roll 14, which is opposite the plate insertion side (X axis). The position of the roll 14 is sensed by encoder 32 which transmits its signal to the CPU to enable reading of the roll height on a suitable display. The operator will then bring the lower roll 12 (W axis) down completely so as to "open the machine" to enable a plate 15 to be inserted.

The first plate is then inserted arranging it horizontally between the rolls, moving it forward to rest against the rear roll 14 to achieve perfect squaring. The rise of the lower roll 12 is then actuated so that it moves the plate 15 upwards until pressing the same, with the preloading pressure previously set, against the upper roll 11, gripping it against the latter in a tight grip.

The position sensor 33 of the lower roll 12 (W axis), which was cleared when the lower roll 12 had been previously brought into contact with the roll 11, will now indicate a value equal to the thickness of the plate 15; this plate thickness must be considered as a "nominal" thickness for constructing the bending program.

At this point there are three possibilities of setting the working program of the machine, more precisely:

MANUAL CONSTRUCTION OF THE BASE PROGRAM

When constructing the main working program of the machine, the operator, by setting the machine on manual control, commands the performance of all the sequences which, by moving and deforming the plate, would cause it to bend to the required diameter. The unknown data to be sought by trial and error, in this manual working phase, are in practice only the positions of the two lateral rolls 13 and 14 (X and Y axes). Once these two positions have been identified, the working program is stored, step by step, by means of the standard programming keyboard of the CPU which will pass the information received, such as program steps, in an area of the RAM, assigning to each program step the axis to be controlled and the position to reach. In practice the program is constructed while the piece is formed manually, entering the movements performed by the operator into the memory step by step.

The stored base program can ensure that the machine repeats the same identical movements at each start-up. Nevertheless, this is not sufficient for ensuring that the result of working is identical for a set of plates, since it is impossible to be certain that by working various plates, with the same program, positioning the lateral rolls 13 and 14 (X and Y axes), which confer the final diameter to the plate, always at the same positions, the tubular bodies produced by the machine all have the same diameter, this however being the target to be achieved by the operator.

These possible difference are due mainly to two variables and more precisely to the fact that the thickness and elastic limit or yield point of the plates worked successively, on a same machine, are not always identical to each other due to the dimensional tolerance and the variations in the physical characteristics of the plates which are commercially available.

These differences can be detected by means of the control apparatus described previously, and at this point the apparatus can intervene to compensate automatically should a difference in thickness and/or elastic limit or yield point be found in the plate.

AUTOMATIC COMPENSATION OF DIFFERENCES IN THICKNESS

Once the first operation has been performed, when a successive plate is to be inserted between the rolls to obtain the same diameter, during the gripping phase of the plate between the lower roll 12 and the upper roll 11, the sensor 33 for sensing the thickness of the plate will indicate with extreme precision what is the real thickness of the plate which is about to be worked (W axis). The data item relating to the W axis, supplied by the transducer 33, is transmitted to the CPU which will pass the information in the RAM and will make a comparison with the similar data of the base program previously set. If the comparison reveals identical thickness, the base program previously stored by the operator will be run normally, maintaining the values and the positions of the lateral rolls already in the memory. If on the other hand the comparison of the thickness reveals a difference from that stored in the base program, there are two possible responses: should the difference in thickness be too high compared to the reference percentage value established, this information will be revealed on the appropriate display of the CPU as an alarm indication to the operator, suggesting that a further program suitable for that different plate be run.

Should however the difference in thickness be within acceptable percentage limits, for example within a limit of ±10%, the apparatus itself is capable of entering the appropriate correction in order to modify the working parameters, restricted to the running of the working program, automatically modifying the positioning parameters of the lateral rolls to adapt them to the new and different thickness. In this manner it compensates for the thickness difference of the new plate to confer likewise to the latter the same diameter obtained previously.

This possibility of automatic correction is obtained on the basis of the percentage variation measured in the plate thickness, according to multiplicative factors of compensation of the positions for rolls 13 and 14, stored in the RAM, contained in the general operating program of the non-volatile EPROM of the processing unit. Therefore the CPU, having acquired the correction factors from the file of the RAM, will run the modified program bringing the lateral rolls 13 and 14 of the bending machine to the new positions determined according to this compensation factor. Obviously, once the working of that plate has ended, these compensation modifications will be deleted and the CPU will automatically return to the main working program stored in the RAM.

AUTOMATIC COMPENSATION OF DIFFERENCE IN ELASTIC LIMIT

As mentioned previously, another element which may determine a variation in the real diameter of the worked tubular piece is the elastic limit of the plate used. In fact a harder plate must be formally worked with a greater bend, compared to a plate of the same thickness but softer, in such a way that the elastic spring back which the bent plate undergoes, causes the piece to have an external diameter equal to the required nominal diameter. It is therefore necessary to adjust the lateral shaping roll which bends the plate, modifying its position according to a coefficient of correction of the value of the elastic limit measured.

In order to enable automatic compensation of the working program in the event of the plate having a different elastic limit value, compared to the sample plate, in relation to the reference data stored during programming of the base program, as related previously, it is therefore necessary to be able to control the working pressure of the hydraulic unit. This is made possible by using the pressure transducer 34 (P axis) which is capable of supplying the CPU with a signal proportional to the pressure value necessary in the cylinder 22 to raise the front roll 13, or in the foreground, to the preset position, a pressure which depends on the greater or lesser elastic strength exerted by the iron sheet or plate during working. In fact, on the basis of the principle whereby a harder plate is also more difficult to deform, therefore requiring a greater working pressure, as already explained, an automatic program is loaded in the RAM for acquiring pressures obtained during performance of the first working by the operator: in practice, while the operator runs the base program and therefore bends the first plate, on the basis of the pressure data acquisition program a scale of values is constructed in the RAM during the rise of the lateral roll in the foreground, or front roll, in the example case the left lateral roll or Y axis in FIG. 1. In practice the RAM receives from the CPU the data relating to the pressure values supplied by the pressure transducer 34 and the values of the positions of the lateral roll 13 supplied by the angular transducer or encoder 31 thus building a table of the values of the ascent of said roll, storing in practice the hydraulic working pressure values which are found at each percentage variation preset by the vertical rising stroke of the roll 13, required for deforming the plate. When the operator inserts subsequent plates, if these have identical characteristics to the previous plate or sample plate, that is to say if they have the same elastic limit, the hydraulic pressures which the pressure transducer 34 (P axis) will read in correspondence with the same percentages of stroke of the roll 13, will be identical to those stored previously. If the CPU, when carrying out the comparison, finds that the pressure values measured for the plate being worked and the pressure values of the comparison table previously stored are identical, on reaching a preset percentage value of the position of the front roll 13, for example on reaching 80% of the stroke, i.e. before the roll reaches its final programmed position, the CPU will not enable the comparison with the conditions of the pressure acquisition program loaded previously, allowing instead the run oft he base work program according to data acquired initially, until the positions set are reached normally.

Should however the comparison between the measured pressure values with the stored pressure values, for identical roll positions, show a variation, the CPU, on the basis of the program conditions existing in the RAM, relating to the acquisition and comparison of the pressure values obtained by the transducer 34, having received the latest measurement at the greater comparison position, equal to 80% of the maximum program position, as related previously, will compare the new pressure values with those of the table of sample data previously stored, present in the file of the RAM, detecting that the plate being machined is different from the one of the base program. In this case there are two possible responses: should the difference in elastic limit be too high, this information is indicated on the appropriate display as an alarm indication for the operator, suggesting to him to create a further program more suitable for that particular type of plate. Otherwise, should the difference in elastic limit be below an acceptable percentage value, for example below ±10%, the apparatus automatically modifies the working parameters by adjusting the position of the lateral rolls 13, 14 to the new elastic limit value of the plate, thus compensating this difference to confer the plate with the same diameter obtained previously in this case too.

This possibility of automatic correction is obtained on the basis of the percentages of variation in the pressures measured, according to multiplicative compensation factors preprogrammed and prestored in the RAM. In fact, on the basis of the percentage of variation of the elastic limit, the EPROM has entered in the RAM coefficients of increment or decrement of the final height which the lateral rolls 13, 14 (X and Y axes) must reach in order to confer the plate being worked with the same diameter envisaged for the main program. Therefore, having acquired these multiplicative factors from the RAM file, the CPU will run the work program bringing the lateral rolls 13, 14 to the new positions, compensated by the multiplicative factors identified. Obviously once working of this plate has ended, these compensation modifications will be deleted, resetting the base work program of the machine.

GEOMETRIC CONSTRUCTION OF THE PROGRAM

According to the invention there is the possibility of "geometric" construction of the main working program of the machine. In this case the operator, by means of the appropriate programming keyboard of the CPU, communicates to the apparatus, writing them in the RAM, the characteristic data of the reference plate, such as size of the sheet, elastic limit of the material and thickness, as well as the working data required such as final outer diameter of the piece to be obtained. The EPROM will then take these data from the RAM and will apply them to calculation formulae already stored inside a coprocessor 27 which will calculate the data of a main working program which, through the EPROM, will be communicated to the RAM which will control them in a similar manner to the program constructed manually by the operator.

The above is made possible thanks to a series of analytical formulae stored in the coprocessor, which can be obtained from experimental data, which comprise some variable parameters such as those relating to the dimensions of the plate, its thickness, elastic limit, and to the diameter to be obtained, as well as other fixed parameters with the aim of processing these data so as to construct a work program automatically with indications of the value of pressure for gripping the plate, the positions of the shaping rolls 13, 14 and the value of the diameter of the bent part.

Naturally, by basing this programming on theoretical formulae, even if derived from experience, and having to acquire, as is known, a data whose real value is often unknown, such as the elastic limit of the plate, it is possible that when running the program automatically, at the first attempt a different diameter from the one required is obtained. Therefore, by means of the information obtained by measuring the piece directly or in another way, the operator communicates the real value of the diameter effectively obtained to the apparatus, keying it in on the programming keyboard so that the EPROM retransfers this data to the coprocessor to compare it with the one previously processed and thus, bearing in mind the error obtained, modifies the program to adjust the position of the lateral rolls (X and Y axes) slightly so as to obtain the required diameter. Naturally, even if the second result were to involve some slight differences, the operation may be repeated to correct the program further, in this way optimising the result,

CONTROLLED AUTOMATIC CONSTRUCTION OF THE PROGRAM

Figure 2:
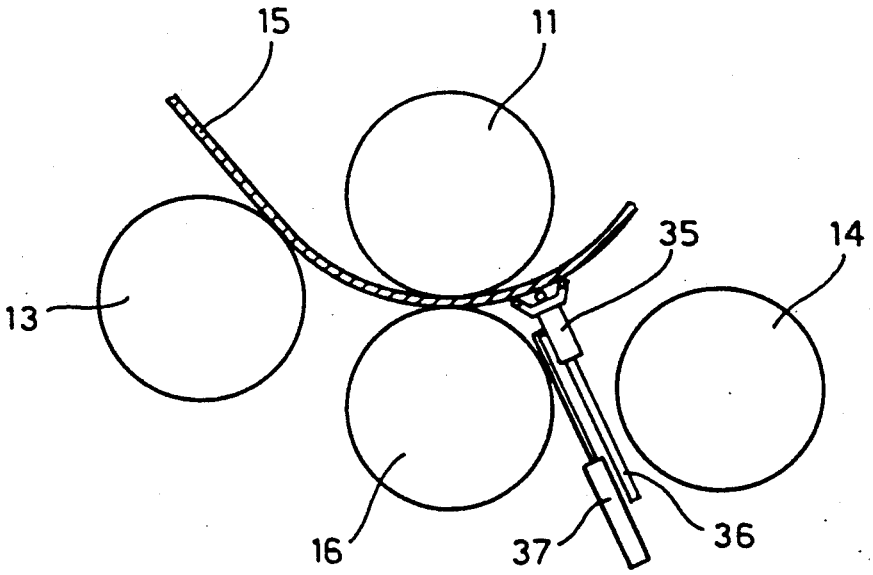
FIGS. 2 and 3 are enlarged details, indicating the different arrangements of the rolls in two different phases of bending the plate.
Figure 3:
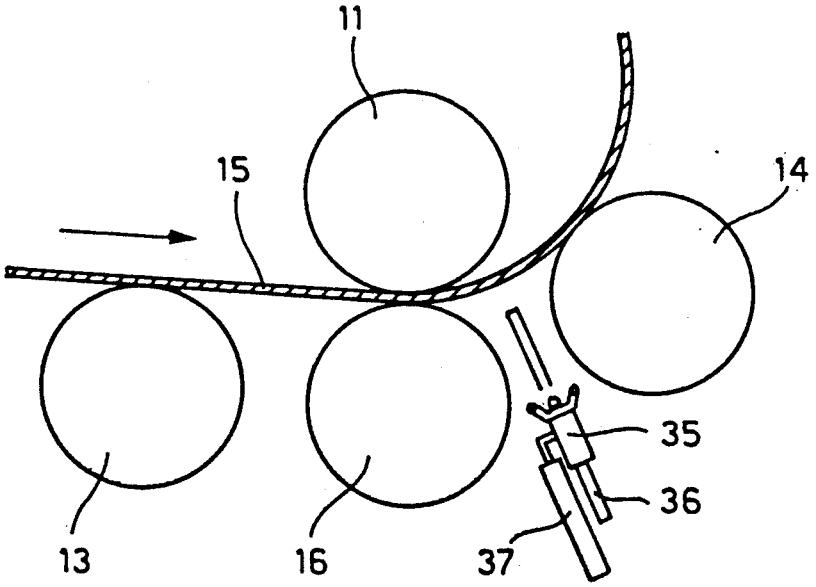

With the apparatus according to the invention a third solution is possible which enables a controlled and automatic construction of the main working program. In pratice it is a question of repeating the previous operations with the addition of a phase of instantaneous compensation of the program during working achieved by using the transducer 34 previously mentioned. In practice, after the coprocessor has calculated the positions to which the lateral rolls 13, 14 are to be brought, in the manner illustrated previously, by launching the program, the sensing element 35 for measuring the diameter is actuated and which, during the forward movement of the plate, checks that the diameter being conferred to the piece is exactly the one required. In practice, as related previously, the three-point sensor 34 is a control means which reads the diameter of the bent plate on the basis of the calculation principle of the chord of a circumference; therefore, in the event of it sensing a difference, it supplies the CPU with a signal on the basis of which the error is immediately compensated modifying the position of the lateral roll which is performing the working in such a way as to obtain the diameter required. In practice the sensing device 35 is brought into contact with the bent plate, as shown in FIG. 2, to which it adheres with the two external contact points which have a known fixed distance between them, and reads, by means of an intermediate sensor, the position of the means point of the section of circumference between the two end points. Since the coprocessor 27, on the basis of calculation formulae set, has calculated in advance for each program what this measurement must be while the plate is deformed and bent by the machine, the device reads with a certain frequency the real bend and communicates it constantly to the CPU; the latter transmits it to the coprocessor which compares it will what has already been processed and with the position of the roll which the required diameter should determine. If the data received from the reading of the diameter of the plate during working is identical to that calculated by the coprocessor, this confirms that the diameter being formed on the machine coincides with the one required, in this way maintaining the position of the lateral roll. If, on the contrary, the value read by the device differs from the theoretical value calculated by the coprocessor, the latter identifies the error instantaneously, evaluates its geometric characteristic, that is to say it identifies whether the piece being worked has a more open or more closed diameter than the one required, and consequently modifies the position of the lateral roll by raising it, if the diameter is too open, or lowering it if the diameter is too closed, thus restoring the required result. This action is controlled by the CPU which transmits the appropriate control pulses to the solenoid valves 25 which control the movement of the lateral rolls. The subsequent new sensing of the measurement by the three-point sensor 35 enables the position reached by the rolls to be maintained, if the diameter is the correct one, or carries out a new correction in the case of further error.

From what has been said and shown it can therefore be understood that a plate bending machine is provided with innovative characteristics due to the provision of the operative system for controlling working which enables the working program to be adapted to the real characteristics of the plate being worked, giving the possibility of adapting each time, both manually and automatically, the data of the working program being run, to restore them to the values of a preset main working program, The great working versatility which the machine thus has, enables working to be performed with great precision, ensuring that the required results are obtained in terms of maintainance of the diameters of the worked parts, with extremely narrow tolerances which cannot be obtained on tradition plate bending machines.

It is therefore intended that what has been said and shown with reference to the accompanying drawings has been given purely by way of an example of the general solution idea of the present invention, and that the various control and data sensing devices may also be modified or changed in relation to what is shown, without thereby departing from the innovative principles which are claimed.

What is claimed is:

1. A programmable automatically controlled plate bending machine comprising:

an upper and a lower gripping roll mounted for rotation with a metal plate passing therebetween, said lower gripping roll being supported by slide members and a pressure sensing means for said lower gripping roll;

lateral rolls placed on either side of said gripping rolls, each of said lateral rolls being mounted for a rotational movement on pivotable arms and a drive means connected to said pivotable arms to move said lateral rolls with respect to said upper gripping roll of the bending machine;

a position sensing means connected to the pivotable arms to provide position control signals for said lateral rolls and pressure sensing means for said lateral rolls to provide spring-back signals from the metal plate at the start of a bending operation of the bending machine;

the machine further comprising a curvature sensing device to continuously sense a radius of curvature of the bending metal plate at an exit side of the upper and the lower gripping rolls;

and a central processing unit, whose input signals includes a position signal and a pressure signal provided by said position and said pressure sensing means, said processing unit comprising a program memory for storing a general operating program of the bending machine, and a memory programmable with a main working program defining predetermined working positions for said lateral rolls, and means to modify said main working program according to data signals received from said position and said pressure sensing means at the start of a working cycle of the bending machine, and to continuously modify said program according to curvature control signals continuously received by said curvature sensing device, during the working cycle of the bending machine.

2. A bending machine according to claim 1 further comprising a program means for automatically and continuously compensating for a detected difference between a thickness of the plate being worked and a value of a thickness of a reference plate stored in the main working program by continuously varying the position of the lateral rolls so as to bend the plate being worked with the same nominal diameter as the diameter predetermined by the main working program.

3. A bending machine according to claim 2, in which said program means for automatically and continuously compensating the position of the lateral rolls comprise a control device for measuring the thickness of the plate, said control device being connected to data input of the processing unit (CPU) to supply a data indicating a real thickness of the plate to be bent, said processing unit (CPU) being programmed to compare the data received with data of a memorized comparison table indicating the final positions of the lateral rolls in relation to different thicknesses of plates provided in the main working program of the processing unit (CPU), and subsequently modifying the data of the main working program to vary the positions of the lateral rolls.

4. A bending machine according to claim 3, in which said thickness control device for measuring the thickness of the plate is operatively related to said lower gripping roll.

5. A bending machine according to claim 4, in which said thickness control device for measuring the thickness of the plate comprises said lower gripping roll, said control means for controlling the movement of the lower gripping roll and a resettable sensing means for sensing the position of the lower gripping roll in relation to the upper drawing roll.

6. A bending machine according to claim 5, in which said sensing means for sensing the position of the gripping roll is a linear sensor connected to one of a supporting slide for the gripping roll and said control means for controlling the movement of the lower gripping roll.

7. A bending machine according to claim 2, in which when a detected plate thickness exceeds a preset value in the main working program of the bending machine, said processing unit (CPU) supplies an alarm signal, preventing said main working program from being run.

8. A bending machine according to claim 1, further comprising control means for automatically compensating the positions of the lateral rolls according to a difference in a detected elastic limit in the plate being worked, in relation to a stored reference value of the main working program.

9. A bending machine according to claim 8, in which said control means for compensating the position of the lateral rolls according to the detected elastic limit of the plate, comprise a control device for detecting a stress initially exerted by at least one of the lateral rolls in bending the plate being worked, said control device being connected to the data input of the processing unit (CPU) the latter being programmed to compare a detected data with similar comparison data of the stress values for bending a reference plate contained in the main working program, subsequently modifying the data of the main working program to vary the position of the lateral roll as a function of compensation factors of a comparison table between said elastic limit values and the roll positions contained in the main program, to bend the plate being worked with the same nominal diameter.

10. A bending machine according to claim 9, comprising control means for measuring the stress values for bending a plate for a series of successive time instants, and program means to carry out said comparison when the lateral roll reaches a pre-established position preceding a maximum upper position of said lateral roll according to the main working program of the bending machine.

11. A bending machine according to claim 9, in which the control means for moving the lateral rolls comprise hydraulic control cylinders, said bending machine comprising a pressure transducer in a feeding conduit for feeding pressurized hydraulic fluid to said control cylinders, in which a signal output of said pressure transducer is operationally connected to a data input of the processing unit (CPU), said stress values for bending the plate being revealed by the pressure values of the hydraulic fluid fed to said control cylinders.

12. A bending machine according to claim 10, in which when the lateral roll reaches said pre-established position and there is a difference in bending stresses greater than a value preset in the main working program, said processing unit (CPU) supplies an alarm signal preventing the main working program from being run.

13. A bending machine according to claim 1, in which said processing unit (CPU) is connected to a coprocessor (CP) provided with a program for calculating data of a working program, starting from settable data in the programmable memory (RAM) relating to characteristics of the plate to be worked, in particular the thickness, the width and the elastic limit, as well as the nominal diameter of said plate, said coprocessor (CP) automatically calculating the position which the lateral rolls must assume as a function of said settable data.

14. A bending machine according to claim 1, comprising a control deice for controlling the diameter conferred to the plate during bending, and drive means for moving said diameter control device between a close position, touching the plate to be bent, and a position far from said plate.

15. A bending machine according to claim 14 in which said diameter control device comprises a three points sensing means arranged along a chord of an arc of a bending circle of the plate being worked, and in that the signals supplied by said diameter control device are fed to the data input of the processing unit (CPU) to be entered in a calculating program for the envisaged bending diameter in a coprocessor (CP) connected to said processing unit (CPU).

16. A bending machine according to claim 15 in which said calculating program of said coprocessor (CP) comprises a table of theoretical values of the length of chords subtended between the three points of said sensing means, as a function of a set of nominal bending diameters, and in that said coprocessor (CP) makes a comparison of the measured values of the cord length with a theoretical value of said table, identifying any error on the basis of which the processing unit (CPU) provides a control signal to said control means for moving said lateral roll.

* * * * *